US006003519A

United States Patent [19]

Gueret

[11] Patent Number: 6,003,519

[45] Date of Patent: Dec. 21, 1999

[54] DEVICE FOR THE TREATMENT AND/OR MAKE-UP OF KERATIN FIBRES

[75] Inventor: Jean-Louis H. Gueret, Paris, France

[73] Assignee: L'Oréal S.A., Paris, France

[21] Appl. No.: 09/129,890

[22] Filed: Aug. 6, 1998

[30] Foreign Application Priority Data

Aug. 7, 1997 [FR] France ..... 97 10141

[51] Int. Cl.[6] ..... A45D 40/26

[52] U.S. Cl. ..... 132/218; 132/313; 132/320; 132/317; 401/126; 401/122; 15/167.1

[58] Field of Search ..... 132/216, 217, 132/218, 313, 317, 320; 15/160, 167.1, 206; 401/122, 126, 129

[56] References Cited

U.S. PATENT DOCUMENTS

| | | | |
|---|---|---|---|
| 1,620,008 | 3/1927 | Curtis . | |
| 1,793,768 | 2/1931 | Anderson . | |
| 1,806,519 | 5/1931 | Cave | 15/160 |
| 1,812,626 | 6/1931 | Edison | 15/160 |
| 1,909,432 | 5/1933 | Swanson | 15/160 |
| 2,448,603 | 9/1948 | Kevin et al. | 15/167.1 |
| 4,458,701 | 7/1984 | Holland | 132/218 |
| 4,898,193 | 2/1990 | Gueret . | |
| 5,067,195 | 11/1991 | Sussman | 15/167.1 |
| 5,137,038 | 8/1992 | Kingsford | 132/218 |
| 5,556,214 | 9/1996 | Ascolese | 401/126 |
| 5,803,638 | 9/1998 | Gueret | 401/122 |
| 5,873,669 | 2/1999 | Poore et al. | 401/122 |

FOREIGN PATENT DOCUMENTS

| | | |
|---|---|---|
| 2 605 505 | 4/1988 | France . |
| 42 05 935 | 9/1993 | Germany . |

*Primary Examiner*—Gene Mancene
*Assistant Examiner*—Pedro Philogene
*Attorney, Agent, or Firm*—Finnegan, Henderson, Farabow, Garrett & Dunner, L.L.P.

[57] ABSTRACT

A brush for the treatment and/or make-up of a lock of hair holds the lock of hair therein and facilitates the delivery of an even application of product with, preferably, minimal strokes and without depositing excess product. A method of applying product for a lock of the hair includes loading product onto the bristles of such a brush, contacting the lock with the loaded bristles, and moving the loaded bristles along or around the lock to evenly coat the lock with the product.

27 Claims, 5 Drawing Sheets

DEVICE FOR THE TREATMENT AND/OR MAKE-UP OF KERATIN FIBRES

The invention relates to a novel device for the treatment and/or make-up, in particular the dyeing and/or bleaching, of keratin fibres, such as, preferably, a lock of hair.

The usual method of dyeing locks of hair is to use a flat brush ending in a comb with bristles embedded between its teeth.

Such a device is not without drawbacks: The impregnation of the locks of hair by the product is uneven, being affected by the orientation of the brush. To treat a lock of hair necessitates several strokes of the brush to correct this unevenness, and yet the correction is always imperfect. In particular, the method creates the problem of deposits of surplus product, and therefore of runs. A cap must therefore be worn with holes through which the locks or hair to which the product is to be applied are drawn in order to ensure that it does not run onto the skin.

The problem solved by the invention is how to provide a device capable of applying a product to a lock of hair, the device allowing an even application of the product to the whole of the lock of hair in a limited number of strokes, advantageously in a single stroke of the device along the lock of hair. With such a device there will be no deposits of excess product, which is an advantage from the economic point of view, and it also means that runs are avoided, so there is no need to wear a cap.

The subject of the invention is a device for the treatment and/or make-up of keratin fibres, this device comprising at least one handle means with two ends, a brush comprising a core fixed to a first end of the handle means and a plurality of bristles embedded in the said core, the device being characterized in that for at least a substantial part of its length the core describes an almost closed curve.

The curve extends for a substantial part of the length of the core of the brush in such a way that it can hold a lock of hair inside the loop, throughout the movement of the brush relative to the hair, so that the hair does not "disengage" from the brush in the course of its movement, which "disengagement" would necessitate repositioning the hair with the fingers, an unsatisfactory process when the hair is covered with treatment product or make-up.

The expression "almost closed curve" refers to a curve having two ends separated by a distance "d" and having a greater width "D" defined as the greatest distance between two points belonging to this curve, the curve being characterized advantageously by the fact that $d<D$, preferably $d<2D/3$. Other preferred embodiments include curve characteristics having $d<D/2$ and most preferably $d<D/3$.

The almost closed curve may be rounded or have corners and may define a strictly convex space or may include concavities.

Preferably, the almost closed curve is inscribed within a plane.

The two ends of the almost closed curve define a segment referred to as the opening of the brush.

The almost closed curve may have a center of symmetry, such as, for example, an arc of a circle. It may also have an axis of symmetry. Preferably, when the almost closed curve has an axis of symmetry, the latter is approximately perpendicular to the opening.

At its first end, the almost closed curve is connected to the handle means, either directly or by a segment of the core. This segment may be straight or bent. The core may, at its first end, form any angle with the handle means. It is also possible for this segment to be flexible, allowing the user to position the almost closed curve to suit the location of the lock of hair in question.

The second end of the core may coincide with the second end of the almost closed curve, but it may also continue in a segment of core. The segments of core that may occur at the ends of the almost closed curve may be parallel or may flare apart.

The core may be formed by the helical winding of two branches of a metal wire, with bristles being embedded radially in this core and gripped between these wound branches. Depending on the desired result, the density of the bristles and the diameter of the bristles may be varied. Bristles of different qualities—elastic, low-friction, or with capillary grooves—may be used.

The core may also be made of a thermoplastic material, preferably injection molded, with bristles being fixed to this core by flocking.

Such a device is used as follows: The brush is dipped in the container containing the product to be applied, with which it becomes impregnated. It is possible to provide a suitable wiper device for this brush. However, by simply drawing the brush over the lip of the container any excess product will be removed. The outside of the brush can be used, if so desired, to apply product to a lock of hair in the same way as would be done with a conventional brush. The lock of hair can also be introduced through the opening of the brush, thus placing it inside the loop, and the bristles will penetrate into the interior of the lock of hair. The brush can then be moved back and forth along the hair, optionally with an accompanying movement of rotation around the hair. The lock of hair can thus be treated evenly from end to end. The product is used in more precise quantities and distributed better than with the devices of the prior art.

Such a device is preferably intended for applying a care, make-up, dyeing, or bleaching product for the hair.

FIGS. 1, 2A, 2B, 2C, 3, and 4 are perspective views of devices according to the invention. For simplicity's sake, only part of the handle is illustrated in FIGS. 2A, 2B, 2C, 3, and 4.

Figure 1:
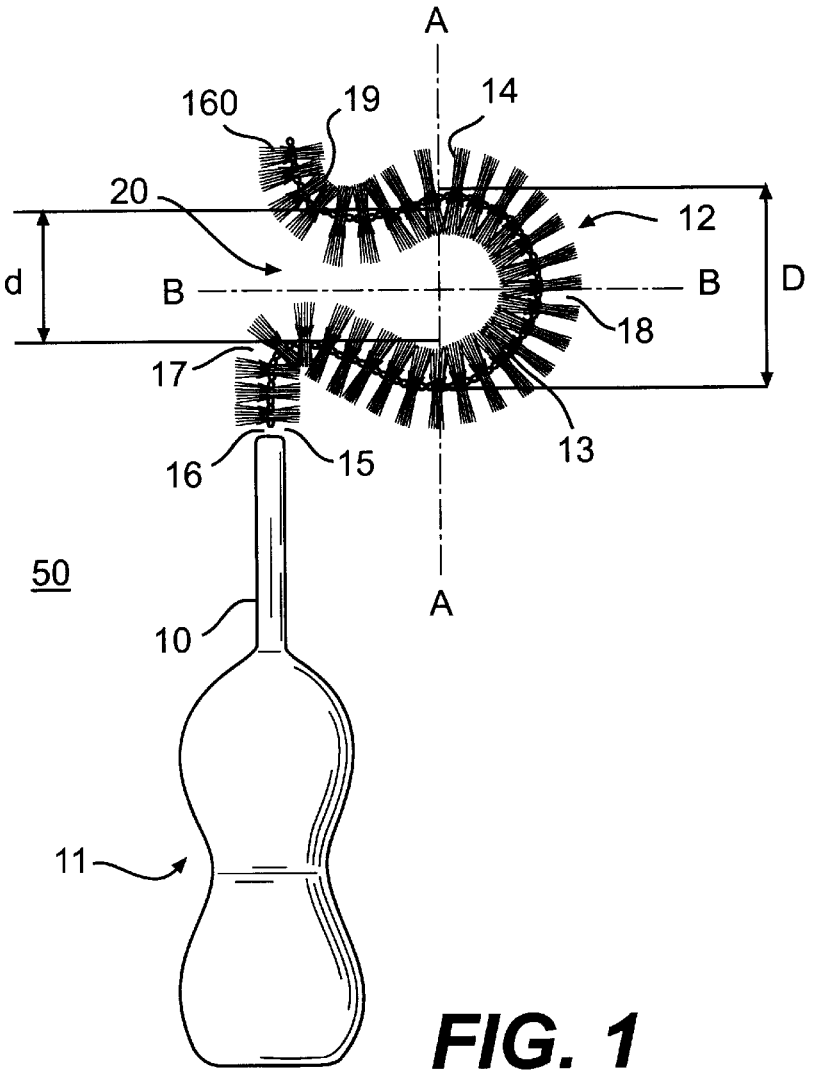

The device 50 shown in FIG. 1 comprises a straight handle 10 having an ergonomic indentation 11 and a brush 12 having a core 13 made from two twisted metal wires (not shown), with bristles 14 being embedded radially in this core 13 and gripped between these wound branches. Fastened to the end 15 of the handle is a first end 16 of the core 13. In the vicinity of this first end 16, the core 13 has a first rounded bend 17 forming a generally closed angle, after which it describes an almost closed curve 18 inscribed within a plane in the form of an arc of a circle, which ends in a second rounded bend 19. The area located between the two bends 17, 19 defines the opening 20 of the curve 18. The width d of the opening is less than ⅔ of the diameter D of the arc of the circle 18. The area adjacent the opening 20 of the curve 18 is flared to facilitate the introduction of the hair into the curve 18. The distance D is measured along an axis A—A situated in a plane of the curve 18 and perpendicular to an axis B—B of the curve 18, which axis B—B passes roughly through the center of the opening 20 of the curve 18.

Figure 2A:
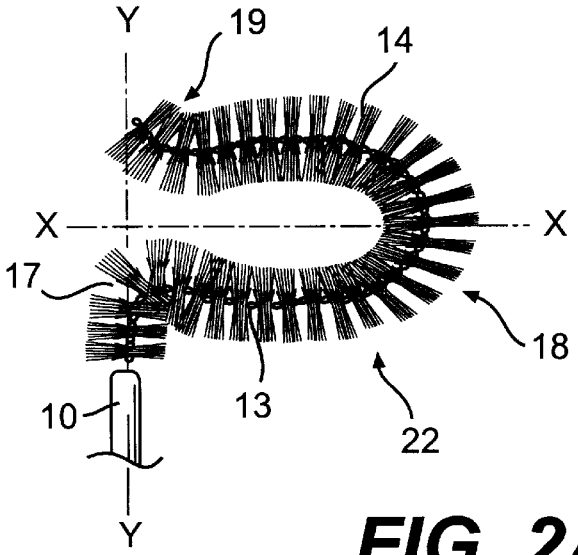

The device shown in FIG. 2A is distinguished from that shown in FIG. 1 by the fact that the first bend 17 is approximately a right angle and not closed and that the core 13 of the brush 12 describes a curve 18 that is elongated along an axis X—X and symmetrical with respect to the axis X—X, the axis X—X being approximately perpendicular to the axis Y—Y of the handle 10. The curve 18 ends in a second rounded bend 19.

Figure 2B:
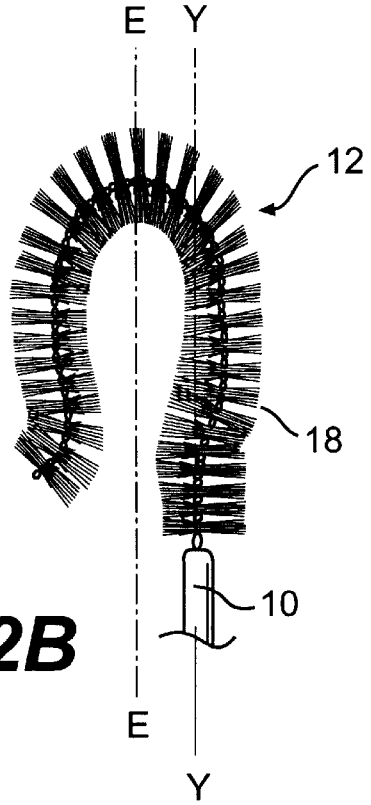

In another variant of the invention, the brush 12 may, as shown in FIG. 2B, describe an elongated curve 18 having symmetry about the axis E—E, which is parallel to the axis Y—Y of the handle 10.

Figure 2C:
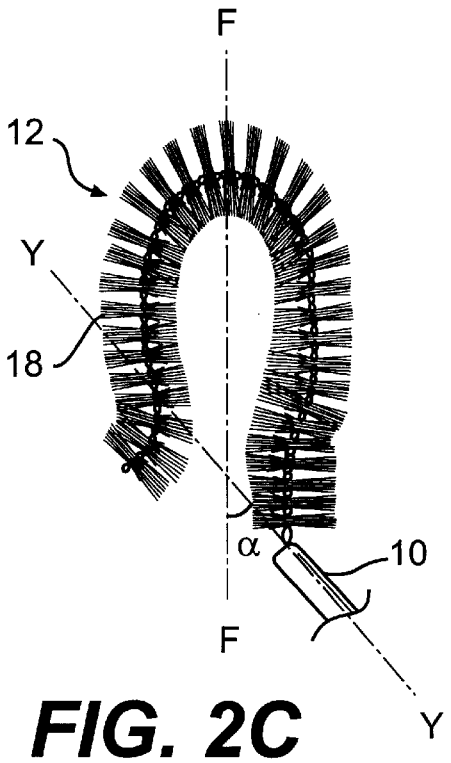

FIG. 2C shows another variant of the invention. The device illustrated here comprises a brush 12 shaped into an elongated curve 18 having symmetry about an axis F—F, this axis forming any angle $\alpha$ with the axis Y—Y of the handle. Preferably, the angle $\alpha$ is between 15° and 45°.

Figure 3:
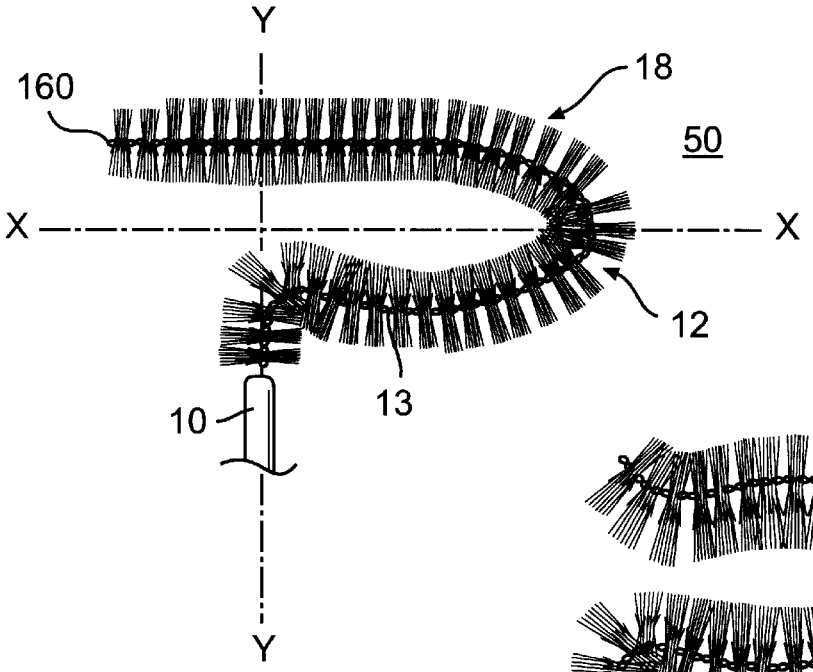

The device 50 of FIG. 3 is distinguished from that of FIG. 2A in that at its second end 160 the curve 18 of the core 13 of the brush 12 does not end in a bend but in a straight section along the axis X—X of the curve 18.

Figure 4:
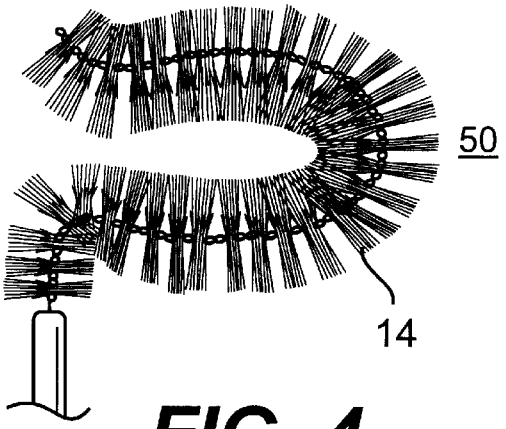

The device 50 of FIG. 4 is distinguished from that of FIG. 2A in that the bristles 14 are much longer. Such a device will particularly assist penetration of the product into the interior of the lock of hair.

Figure 8:
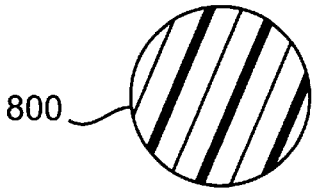
FIG. 8 shows a cross-sectional view of an embodiment having a core made of a thermoplastic material.

FIG. 8 shows a cross-sectional view of a core 800 made of a thermoplastic material.

Figure 5A:
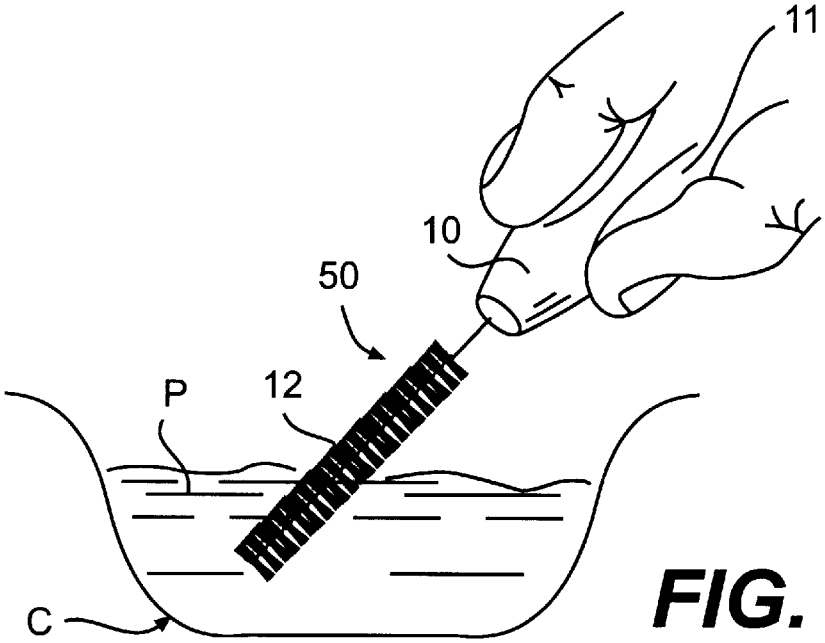
FIGS. 5A to 5D are perspective views illustrating the operation of a device according to the invention.

FIG. 5A shows a device 50 in accordance with those described above. It comprises a brush 12 and a handle 10 comprising a portion 11 designed to enable the user to hold it more conveniently. The brush 12 is immersed in a product P of preferably liquid to pasty consistency in a concave container C. The brush 12 becomes impregnated with the product P.

Figure 5B:
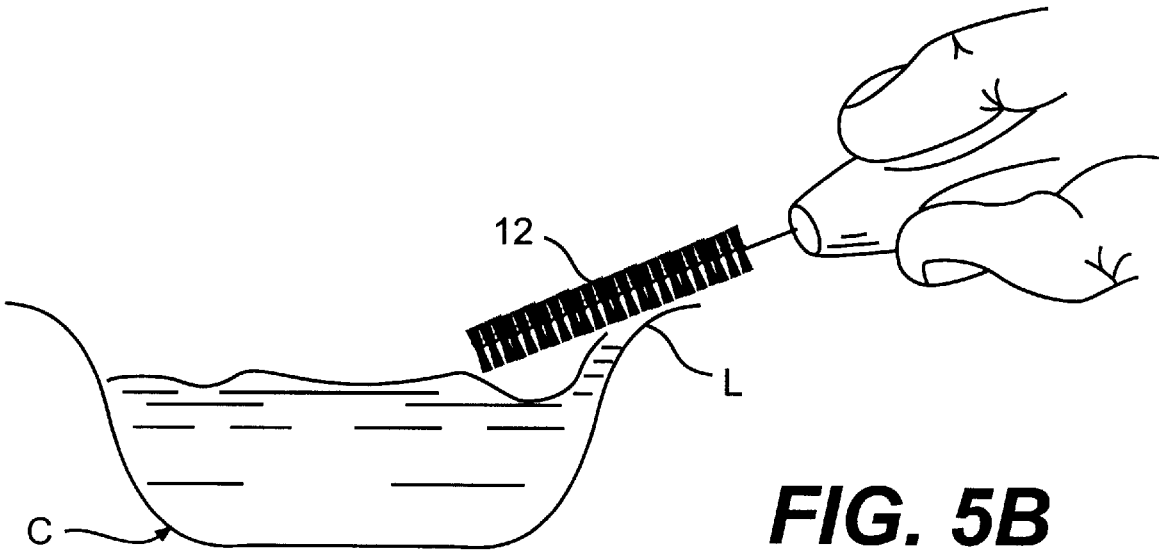

As shown in FIG. 5B, the brush 12 is then wiped against the lip L of the container C.

Figure 5C:
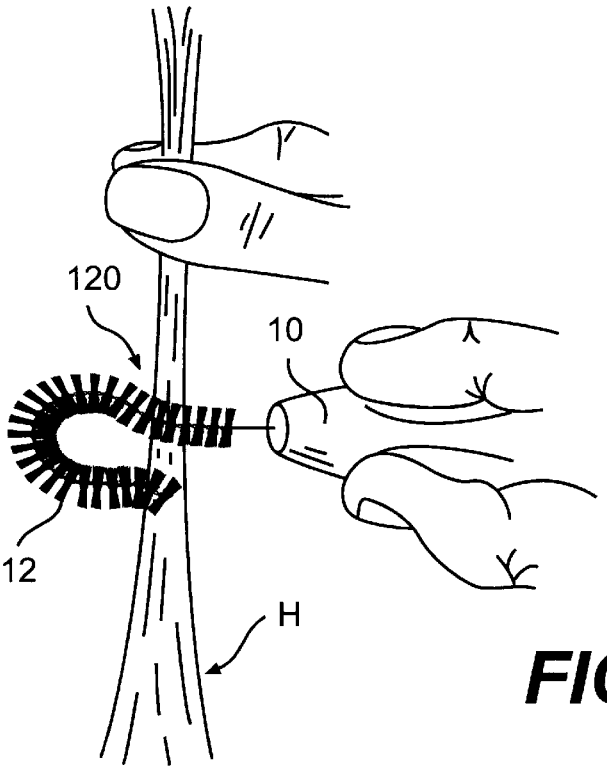

In FIG. 5C the user is seen holding a lock of hair H between the fingers of one hand and the handle 10 of the device between the fingers of the other. The back 120 of the brush 12 is applied to the lock of hair H and charges it with the product P. This step of application can be accompanied by a vertical movement to encourage the product P to be deposited along the full length of the lock of hair H.

Figure 5D:
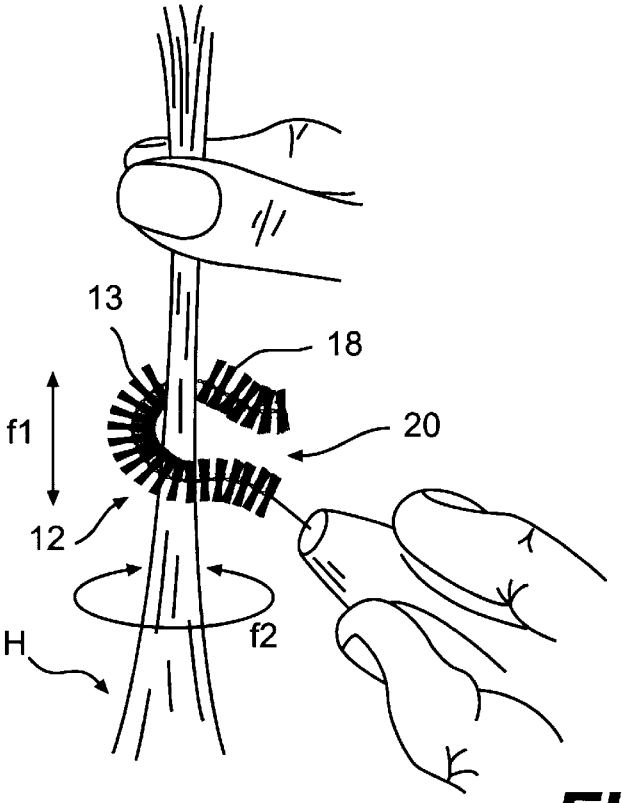

In FIG. 5D the user has introduced the hair H through the opening 20 into the almost closed curve 18 described by the core 13 of the brush 12. The user can then run the brush 12 along the hair H as shown by the arrows $f_1$ and/or in a circular manner as indicated by $f_2$.

Figure 6:
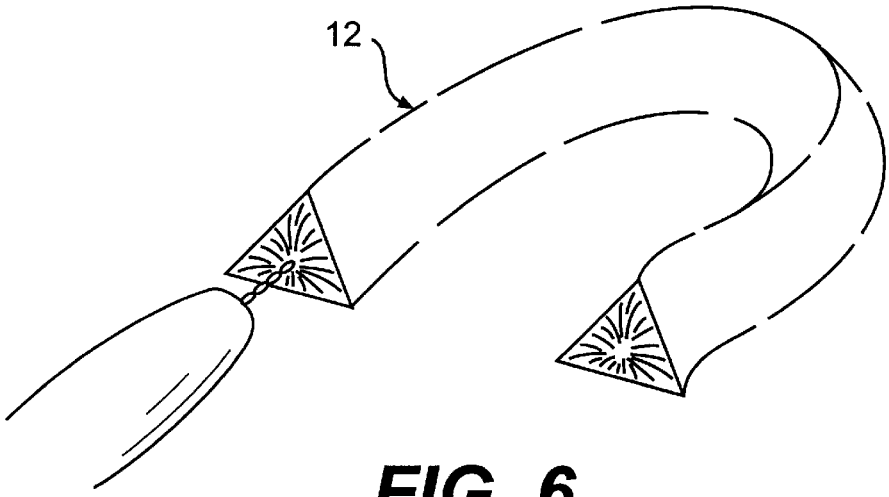
FIG. 6 is a perspective view of a device according to the invention comprising a triangular sectioned brush. For simplicity's sake, only part of the handle has been illustrated.

The devices according to the invention are usually provided with a brush of circular cross-section; in other words, the intersection of the brush with any plane perpendicular to the core is a disc. However, it is possible for a device according to the invention to have a brush of nor-circular cross-section. This is illustrated in FIG. 6, where a device is shown with a brush 12 of triangular cross-section. In other variants of the invention, the brush cross-section could be oval-, square-, or lozenge-shaped. It is also possible for the brush cross-section to vary along the length of the core.

Figure 7:
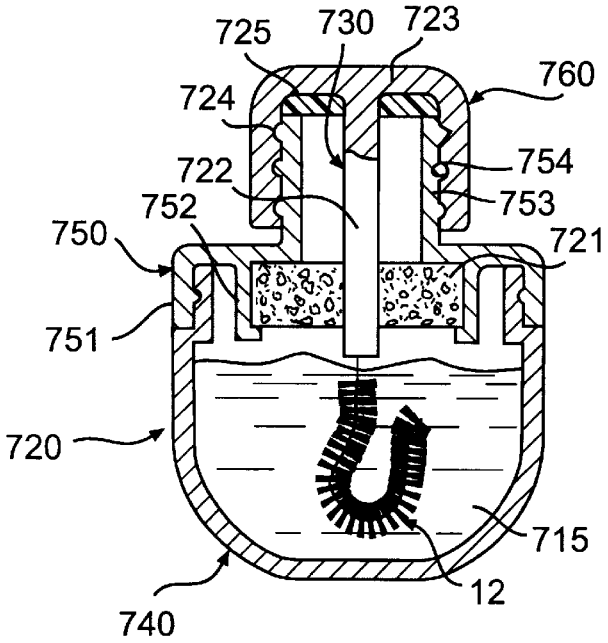
FIG. 7 shows a complete device for the application of a dyeing product in cross-section.

The hair dyeing system shown in FIG. 7 comprises a reservoir 720 consisting of a bowl 740 and dish 750, the latter comprising a first or outer skirt 751, a second or inner skirt 752 and a threaded neck 753. The bowl 740 is fastened to the outer skirt 751 of the dish 750 by known means (e.g., snap fastening). The reservoir 720 is filled with a dyeing cream 715. The neck 753 is surmounted by a seal 725. The reservoir 720 comprises at its upper end, at the opening of the neck 753, a wiper 721, which is held in position by a circular flange in the second skirt 752 of the dish 750. The wiper 721 consists, in a known manner, of a soft and deformable material. An applicator 760 is designed to engage with the reservoir 720. This applicator 760 consists of a handle means 723 to which is attached the application member 730, which comprises a rod 722 and a brush 12 in accordance with those illustrated in the preceding figures. The handle means 723 takes the form of a cap and includes a thread 724 that engages with the thread 754 on the neck 753 of the dish 750. The reservoir 720 is sealed by screwing the handle means 723 down onto the neck 753 of the dish 750 so as to compress the seal 725.

I claim:

1. A device for at least one of treatment and make-up of a lock of hair, comprising:

a handle; and a brush, said brush comprising a core fixed to said handle, wherein said core holds a plurality of bristles and forms a loop having an opening to allow entry therein of said lock, said loop being adapted to hold said lock therein when the bristles are moved in one of a direction along said lock and a direction around said lock to evenly coat said lock with at least one of a treatment product and a make-up product.

2. The device according to claim 1, wherein the opening is less than ⅔ the width defined by the greatest distance between two points of the loop perpendicular to an axis of said loop, said axis passing substantially through the center of the opening of said loop.

3. The device according to claim 1, wherein the opening is less than ½ the width defined by the greatest distance between two points of the loop perpendicular to an axis of said loop, said axis passing substantially through the center of the opening of said loop.

4. The device according to claim 1, wherein said loop is inscribed within a plane.

5. The device according to claim 1, wherein said loop has an axis of symmetry.

6. The device according to claim 5, wherein said axis of symmetry is approximately perpendicular to the opening.

7. The device according to claim 1, wherein said loop has a center of symmetry.

8. The device according to claim 1, wherein said loop is in the form of an arc of a circle.

9. The device according claim 1, wherein said core is formed by the helical winding of two branches of a metal wire, the bristles being embedded radially in this core and gripped between these wound branches.

10. The device according to claim 1, wherein said core is made of a thermoplastic material, the bristles being fixed to this core by flocking.

11. The device according to claim 1, wherein said handle has an ergonomic indentation.

12. The applicator of claim 1, wherein the width of the opening is less than about one-third of the greatest distance between two points on the loop along a line perpendicular to an axis of the loop passing substantially through the center of the opening of said loop.

13. The applicator of claim 1, wherein the core has a first end fixed to the handle and a second end, the core further including a first bend near the first end of the core and a second bend near the second end of the core, wherein the width of the opening is defined as the distance between the first and second bends of the core.

14. The applicator of claim 1, wherein the core has a first end fixed to the handle and a second end, the core further including a first bend near the first end of the core and a straight portion near the second end of the core, the straight portion being substantially perpendicular to a longitudinal axis of the handle, wherein the width of the opening is defined as the perpendicular distance between the first bend and the straight portion.

15. The applicator of claim 1, wherein a portion of the loop formed by the core is elliptically-shaped.

16. A system for dyeing a lock of hair, comprising:

a reservoir containing a dye product; and an applicator designed to engage with the reservoir, wherein said applicator comprises a brush comprising a core fixed to a handle and forming a loop having two ends that are separated by a distance that is less than the width defined by the greatest distance between two points of the loop perpendicular to an axis of said loop, said axis passing substantially through the center of the opening of said loop, said loop being adapted to hold said lock therein when the bristles are moved in one of a direction along said lock and a direction around said lock to evenly coat said lock with at least one of a treatment product and a make-up product.

17. The system of claim 16, wherein one end of the core is fixed to the handle.

18. The system of claim 16, wherein the reservoir includes a threaded neck and the applicator includes a threaded handle, the threads of the handle being capable of engaging the threads of the neck to attach the applicator to the reservoir.

19. The system of claim 18, wherein the reservoir further includes a seal located above the threads on the neck so that the threaded handle of the applicator presses against the seal for sealing off the reservoir when the applicator is attached to the reservoir.

20. The system of claim 16, wherein the wiper includes deformable material.

21. The system of claim 16, further comprising a wiper.

22. A brush for at least one of treatment and make-up of a lock of hair, comprising: a core holding a plurality of bristles and forming a loop having an opening to allow entry therein of said lock, said loop being adapted to hold said lock therein when the bristles are moved in one of a direction along said lock and a direction around said lock to evenly coat said lock with at least one of a treatment product and a make-up product.

23. A system for dyeing a lock of hair, comprising:

a reservoir;

a wiper; and an applicator designed to engage with the reservoir, wherein said applicator comprises a brush comprising a core holding a plurality of bristles and forming a loop having an opening to allow entry therein of said lock, said loop being adapted to hold said lock therein when the bristles are moved in one of a direction along said lock and a direction around said lock to evenly coat said lock with at least one of a treatment product and a make-up product.

24. A method of applying a care, make-up, dyeing, or bleaching product to a lock of hair, comprising the steps of:

(1) loading said product onto bristles of a brush, said brush comprising a core holding a plurality of said bristles and forming a loop having an opening to allow entry therein of said lock, said loop being adapted to hold said lock therein when the bristles are moved along or around said lock;

(2) contacting said lock of hair with said loaded bristles; and (3) moving said loaded bristles along or around said lock to evenly coat said lock with said treatment and/or make-up product.

25. A method of applying a product of liquid to pasty consistency to the hair, comprising the steps of:

(1) loading said product onto bristles of a brush comprising a core holding a plurality of said bristles forming a loop having an opening to allow entry therein of a lock of hair, said loop being adapted to hold said lock therein when the bristles are moved in one of a direction along and a direction around said lock;

(2) contacting said lock of hair with said loaded bristles; and (3) moving said loaded bristles in one of a direction along and a direction around said lock to evenly coat said lock with said product.

26. An applicator for applying product to hair, comprising:

a handle; and a brush including a core having two ends, one end of the core being fixed to the handle, the core holding a plurality of bristles and forming a loop having an opening for receiving a lock of hair, wherein the width of the opening is less than about two-thirds of the greatest distance between two points on the loop along a line perpendicular to an axis of said loop passing substantially through the center of the opening of said loop, said loop being adapted to hold said lock therein when the bristles are moved in one of a direction along said lock and a direction around said lock to evenly coat said lock during application of the product.

27. A system for applying product to hair, comprising:

an applicator including a brush having a core holding a plurality of brush members and forming a loop having an opening for receiving a lock of hair, said loop being adapted to hold said lock therein when the brush members are moved in one of a direction along said lock and a direction around said lock to evenly coat said lock during application of the product; and a container containing a hair product, the container being configured to receive at least a portion of the brush so that the hair product can be transferred from the container to the brush.

* * * * *